US009660390B2

(12) United States Patent
Xing et al.

(10) Patent No.: US 9,660,390 B2
(45) Date of Patent: May 23, 2017

(54) CABLE CONNECTOR ASSEMBLY HAVING AN INSULATIVE HOUSING CONSTRUCTED OF TWO MAIN BODIES

(71) Applicant: FOXCONN INTERCONNECT TECHNOLOGY LIMITED, Grand Cayman (KY)

(72) Inventors: Da-Wei Xing, Kunshan (CN); Jun Chen, Kunshan (CN); Jerry Wu, Irvine, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/238,876

(22) Filed: Aug. 17, 2016

(65) Prior Publication Data

US 2017/0054255 A1 Feb. 23, 2017

(30) Foreign Application Priority Data

Aug. 17, 2015 (CN) ..... 2015 2 0617365 U

(51) Int. Cl.

| | |
|---|---|
| ***H01R 29/00*** | (2006.01) |
| ***H01R 13/6581*** | (2011.01) |
| ***H01R 13/41*** | (2006.01) |
| ***H01R 24/28*** | (2011.01) |
| ***H01R 13/506*** | (2006.01) |
| *H01R 107/00* | (2006.01) |

(52) U.S. Cl.

CPC ..... *H01R 13/6581* (2013.01); *H01R 13/41* (2013.01); *H01R 13/506* (2013.01); *H01R 24/28* (2013.01); *H01R 2107/00* (2013.01)

(58) Field of Classification Search

CPC ... H01R 103/00; H01R 13/635; H01R 13/633

USPC ..... 439/188, 159, 160, 152–155

See application file for complete search history.

(56) References Cited

U.S. PATENT DOCUMENTS

| | | | | |
|---|---|---|---|---|
| 6,835,091 | B2 * | 12/2004 | Oleynick | H01R 12/716 439/541.5 |
| 7,147,501 | B1 * | 12/2006 | Wu | H01R 13/6275 439/352 |
| 9,065,219 | B2 * | 6/2015 | Naito | H01R 13/7033 |
| 9,368,982 | B2 * | 6/2016 | Jansen | H02J 7/0021 |
| 9,379,501 | B2 * | 6/2016 | Taylor | H04Q 1/13 |
| 2015/0357770 | A1 * | 12/2015 | Xing | H01R 13/504 439/676 |

(Continued)

*Primary Examiner* — Phuongchi T Nguyen

(74) *Attorney, Agent, or Firm* — Wei Te Chung; Ming Chieh Chang

(57) ABSTRACT

A cable connector assembly includes: an insulative housing; a number of contacts retained in the insulative housing; a cable including a plurality of wires electrically connected with the contacts and an insulative outer coating enclosing the wires; and a shielding case enclosing the insulative housing; wherein the insulative housing includes a first main body extending along a docking direction and a second main body extending along a direction perpendicular to the docking direction, an end of the second main body is exposed to the first main body along the docking direction, and the insulative outer coating of the cable extends along a direction away from the docking direction to form an angle relative to the extending direction of the second main body.

20 Claims, 8 Drawing Sheets

(56) References Cited

U.S. PATENT DOCUMENTS

2016/0352047 A1* 12/2016 Xing ..... H01R 13/64
2016/0380387 A1* 12/2016 Wu ..... H01R 13/6581
439/95

* cited by examiner

CABLE CONNECTOR ASSEMBLY HAVING AN INSULATIVE HOUSING CONSTRUCTED OF TWO MAIN BODIES

BACKGROUND OF THE INVENTION

1. Field of the Invention

The present invention relates generally to a cable connector assembly and more particularly to a cable connector assembly having an insulative housing constructed of two portions extending perpendicular to each other.

2. Description of Related Arts

U.S. Patent Application Publication No. 20140349523, published on Nov. 27, 2014, shows a cable connector assembly including a connector and a cable. The connector includes a shell having a front shell and a back shell assembled to each other, an insulative housing, and a number of contacts. The front shell includes a mating portion and a bending portion backwardly extending from the mating portion. The insulative housing includes a body portion and a stepped portion extending backwardly from the body portion. The contact includes a tail portion exposed on the stepped portion. The cable includes a number of conductive wires connected with the tail portions of the contacts. The bending portion is mated with the back shell. The bending portion is aligned with the cable to form an angle with respect to the mating portion.

An improved cable connector assembly is desired.

SUMMARY OF THE INVENTION

An object of the present invention is to provide an improved cable connector assembly.

To achieve the above-mentioned object, a cable connector assembly comprises: an insulative housing; a plurality of contacts retained in the insulative housing; a cable including a plurality of wires electrically connected with the contacts and an insulative outer coating enclosing the wires; and a shielding case enclosing the insulative housing; wherein the insulative housing includes a first main body extending along a docking direction and a second main body extending along a direction perpendicular to the docking direction, an end of the second main body is exposed to the first main body along the docking direction, and the insulative outer coating of the cable extends along a direction away from the docking direction to form an angle relative to the extending direction of the second main body.

DETAILED DESCRIPTION OF THE PREFERRED EMBODIMENT

Figure 1:
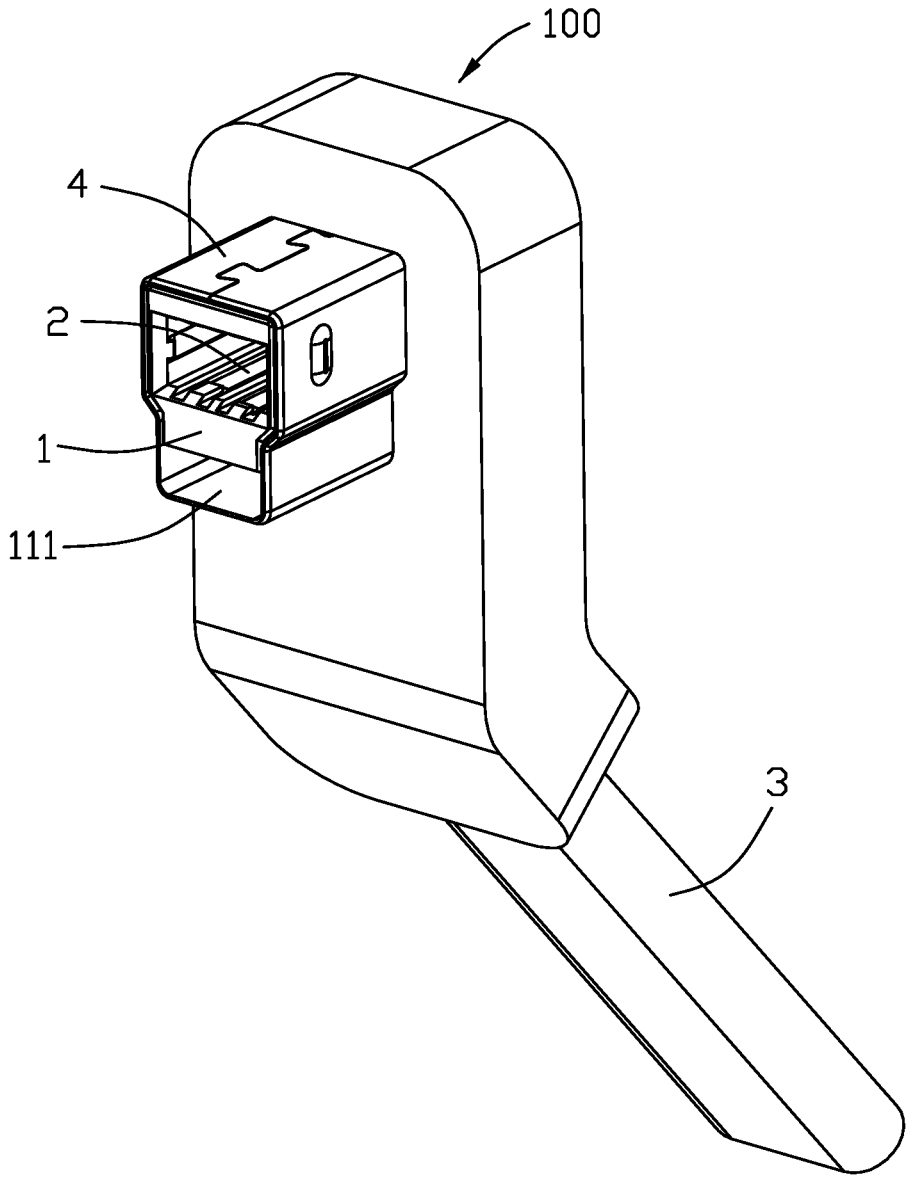
FIG. 1 is a perspective view of a cable connector assembly in accordance with the present invention.
Figure 2:
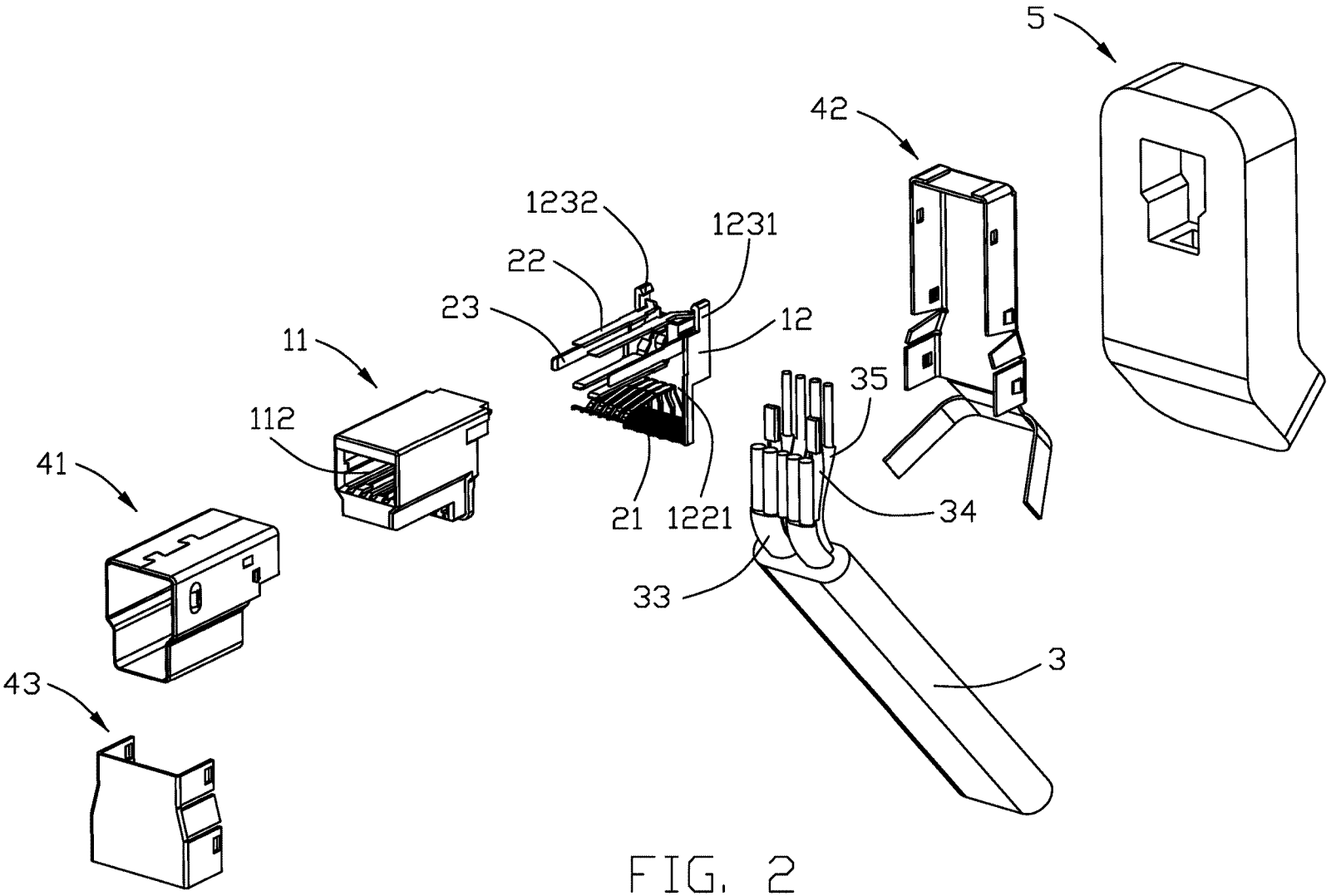
FIG. 2 is an exploded view of the cable connector assembly in FIG. 1.
Figure 3:
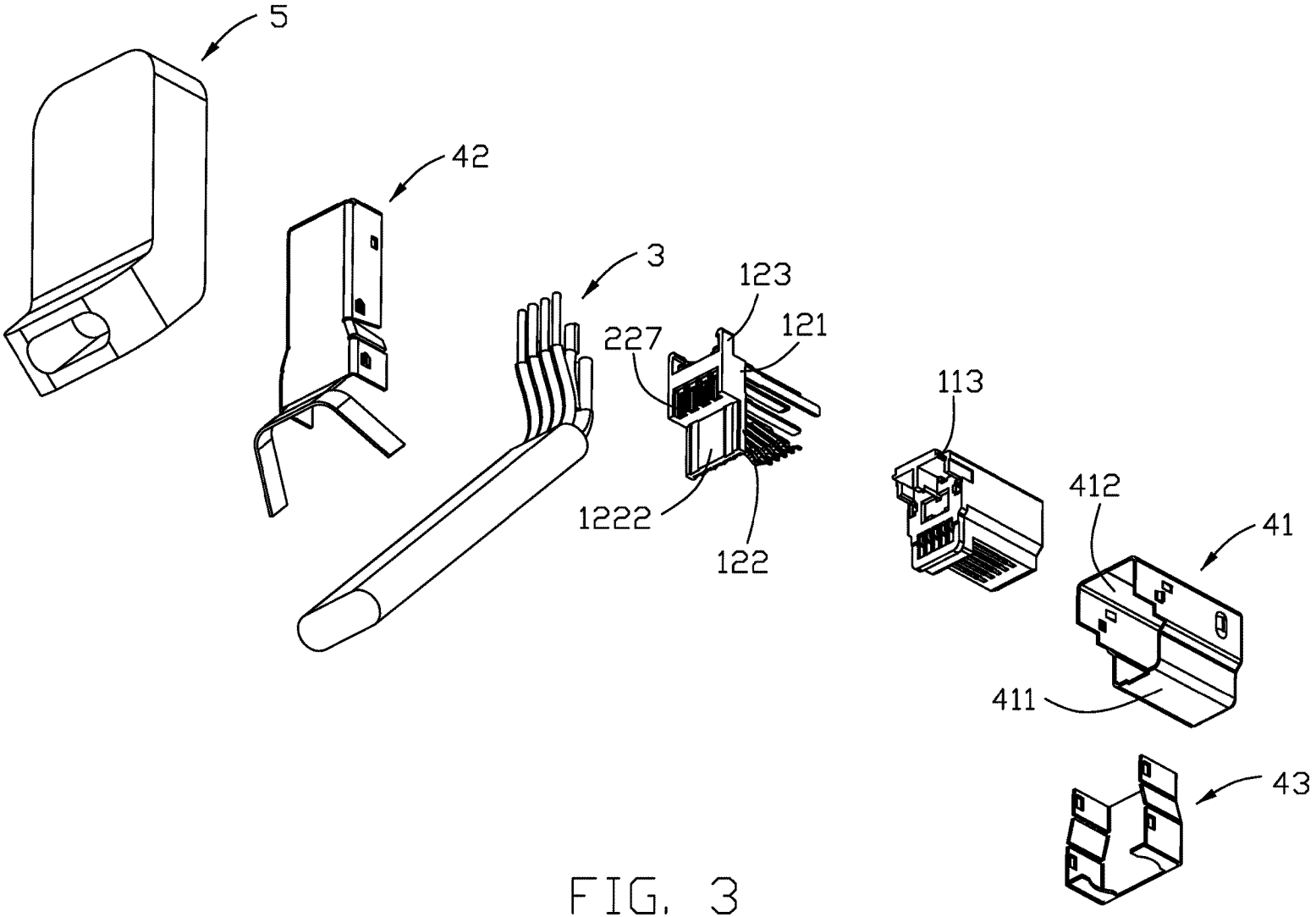
FIG. 3 is an exploded view similar to FIG. 1, but from a different perspective.
Figure 4:
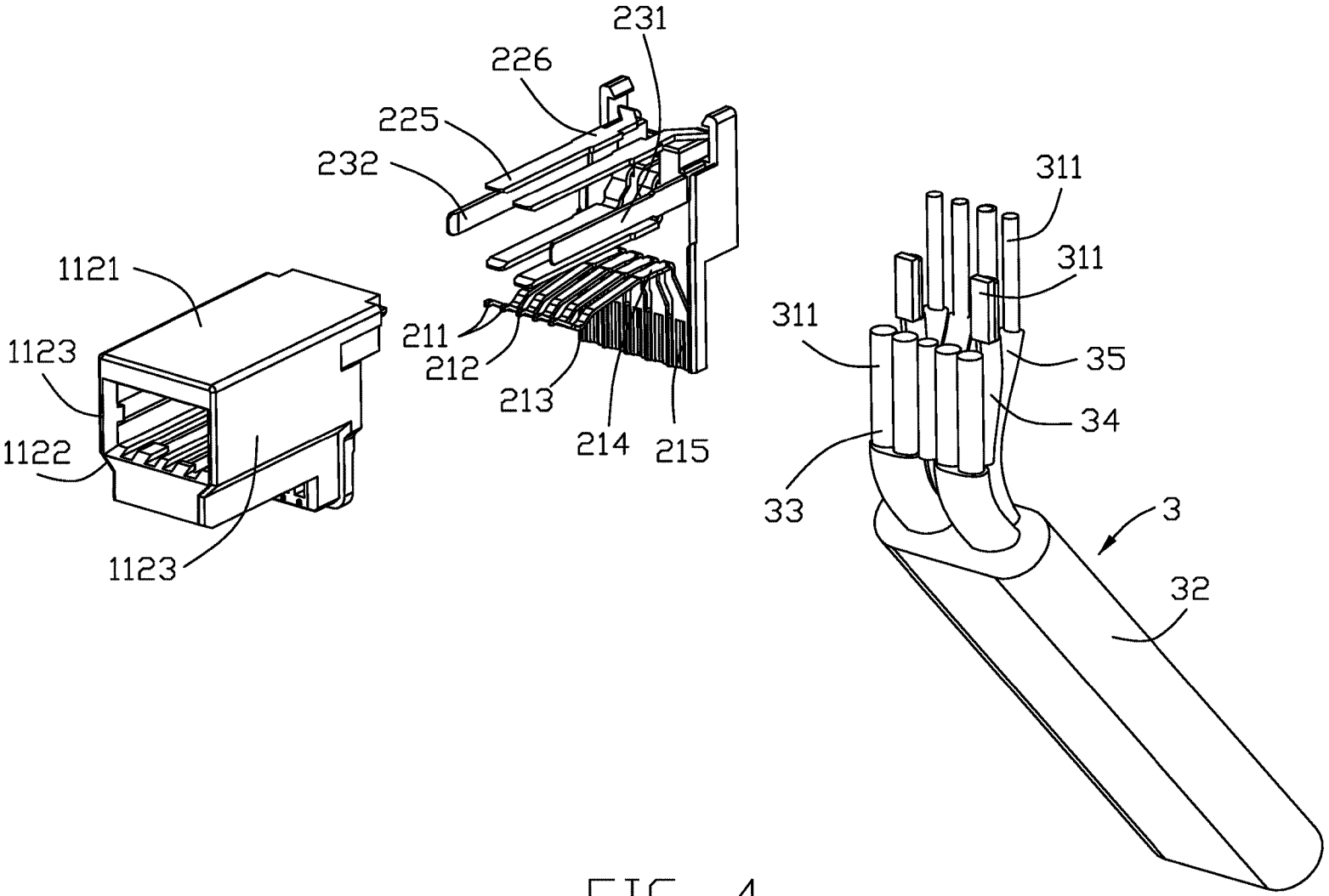
FIG. 4 is an exploded view of a part of the cable connector assembly in FIG. 1.
Figure 5:
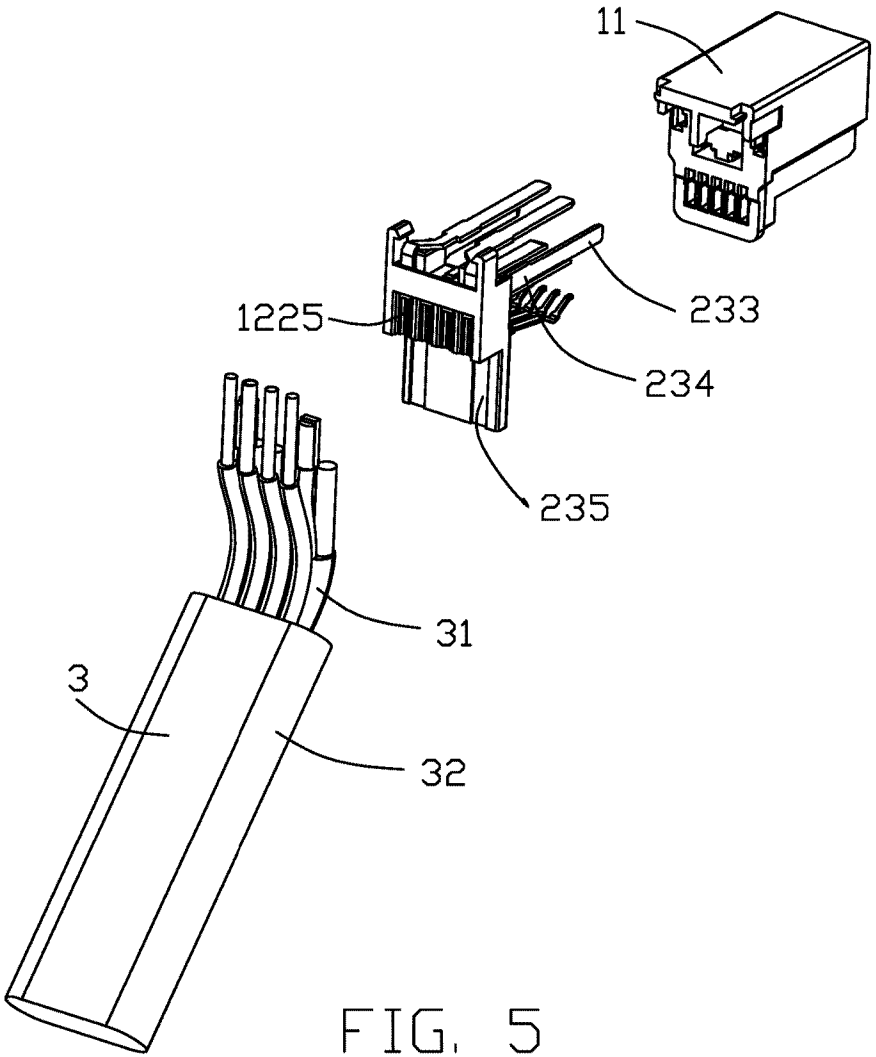
FIG. 5 is an exploded view similar to the FIG. 4, but from a different aspect.
Figure 6:
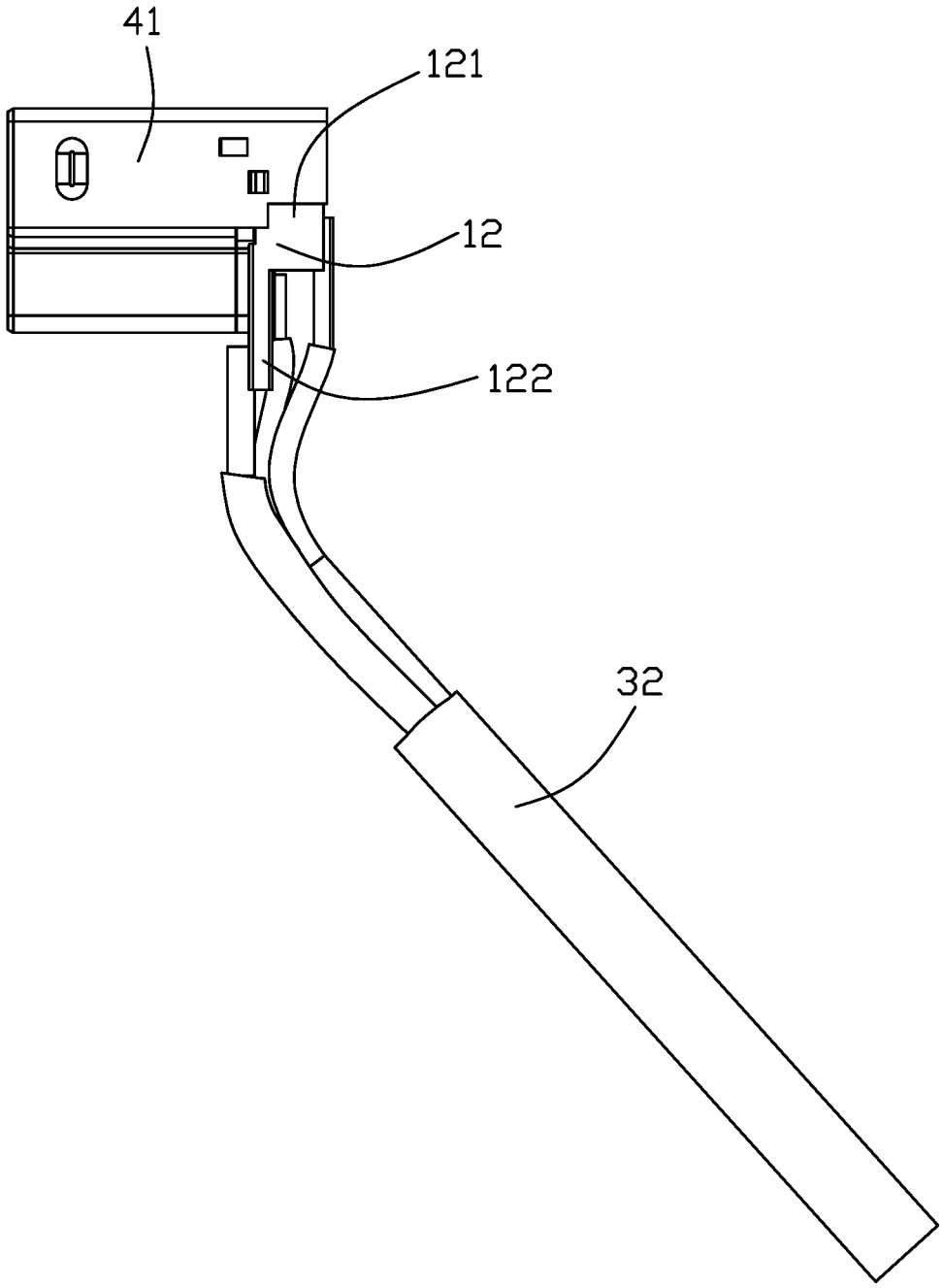
FIG. 6 is a plan view of the cable connector assembly in FIG. 1, not including the first shielding case and the third shielding case.
Figure 7:
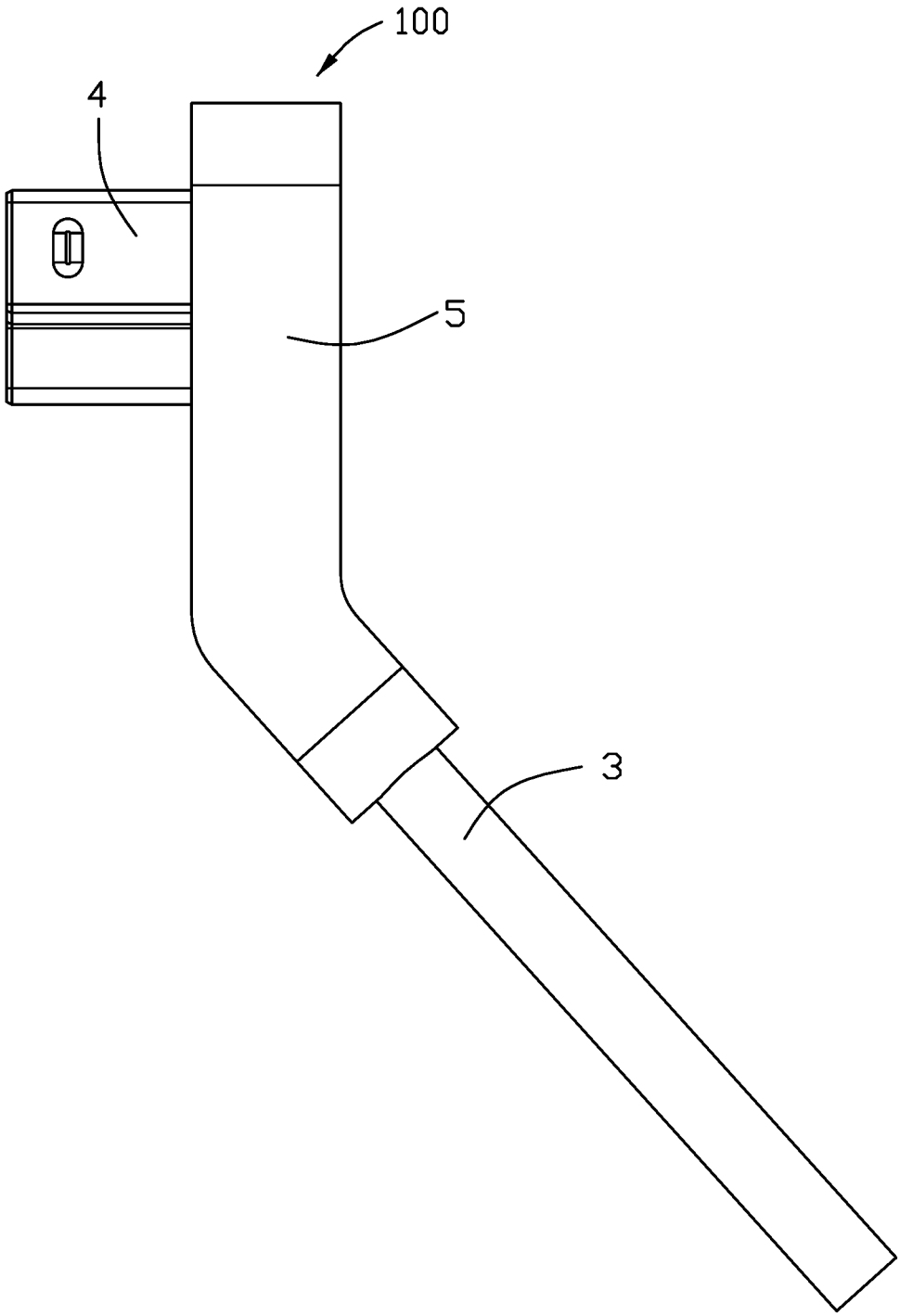
FIG. 7 is a lateral view of the cable connector assembly in FIG. 1.
Figure 8:
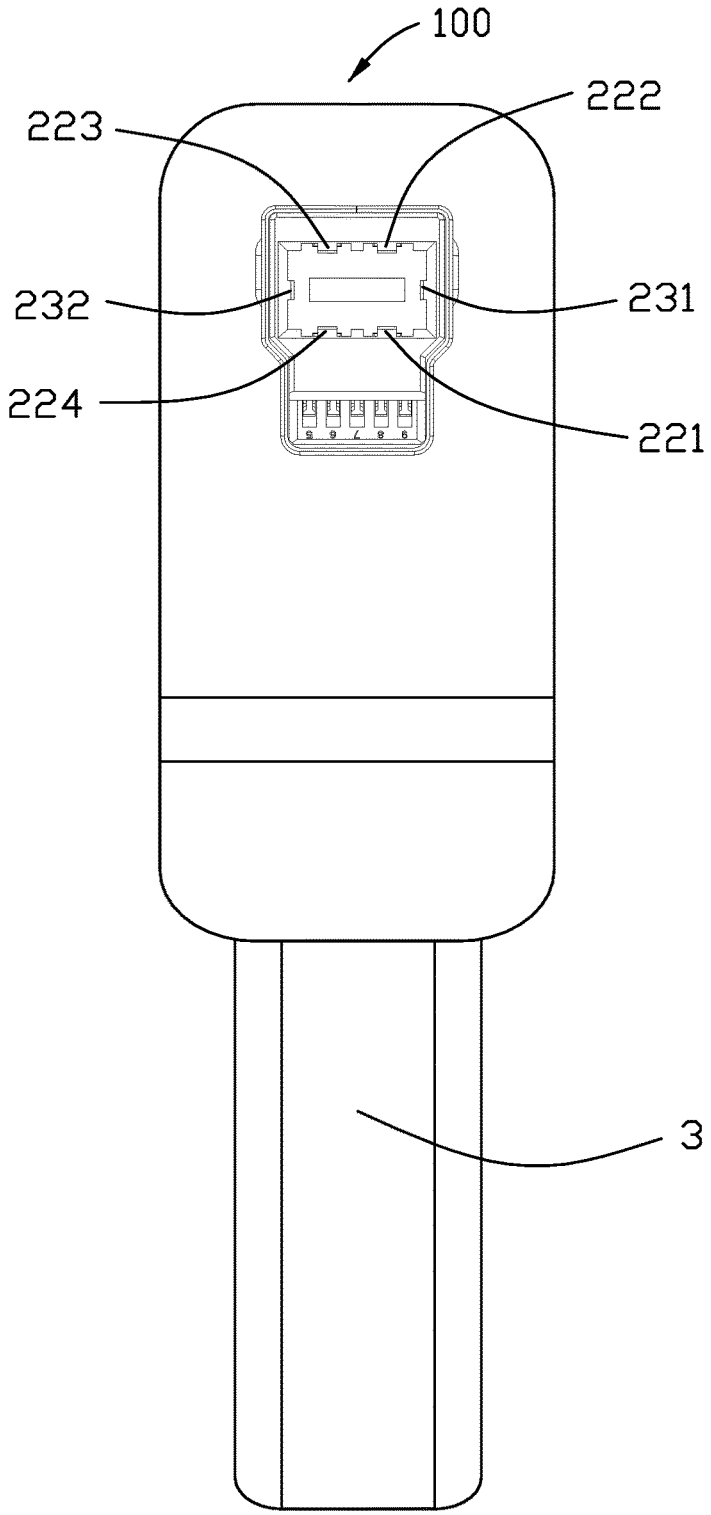
FIG. 8 is a front view of the cable connector assembly in FIG. 1.

Referring to FIGS. 1 to 7, a cable connector assembly in accordance with the present invention for mating with a mating connector (not shown), comprises an insulative housing 1, a plurality of contacts 2 retained in the insulative housing 1, a cable 3 electrically connected with the insulative housing 1 and a shielding case 4 enclosing the insulative housing 1. In the present embodiment, the cable connector assembly 100 is a B-type USB connector. The contacts 2 include a plurality of first contacts 21 for transmitting high-speed signals, a plurality of second contacts 22 for transmitting low-speed signals and a plurality of third contacts 23.

The first contacts 21 includes two pairs of differential signal contacts 211 and a grounding contact 212, all of which are arranged in accordance with standard type B USB 3.0 arrangement. One of the two pairs of differential signal contacts 211 is used for outputting high-speed signals, another is used for receiving high-speed signals. The grounding contact 212 is located between the two pairs of differential signal contacts 211, for reducing the differential signal terminals 211 crosstalk in high-speed signal transmission. Each of the first contacts 21 includes a front resilient contacting portion/section 213, a fixing portion 214 rearwardly extending from the contacting portion 213 and a rear soldering portio/section 215 downwardly extending from the fixing portion 214.

The second contacts 22 include four contacts, which include a power contact 221, a grounding contact 222, a positive signal contact 223 and a negative signal contact 224, all of which are arranged in accordance with standard type B USB2.0 arrangement. Each of the second contacts 22 includes a front plate-shaped contacting portion/section 225, a fixing portion 226 rearwardly extending from the contacting portion 225 and a rear soldering portion/section 227 downwardly extending from the fixing portion 226.

The third contacts 23 includes a additional power supply contact 231 and an additional grounding contact 232. Each of the third contacts 23 includes a front plate-shaped contacting portion/section 233, a fixing portion 234 rearwardly extending from the contacting portion 231 and a rear soldering portion/section 235 downwardly extending from the fixing portion 234.

The insulative housing 1 includes a first main body 11 extending along a docking or front-to-back direction of the cable connector assembly 100 and a second main body 12 downwardly extending from the first main body 11 along a direction perpendicular to the docking direction. The first main body 11 defines a first receiving room 111 and a second receiving room 112. The second receiving room 112 is superimposed on the first receiving room 111 in the vertical direction. The second receiving room 112 is surrounded by a top wall 1121, a bottom wall 1122 and two side walls 1123. The additional power supply contact 231 and the additional grounding contact 232 of the third contacts 23 are received in two inner sidewalls of the two side walls 1123 respectively. The contacting portions 225 of the second contacts 22 are arranged in two rows, and both rows are received in the inner sidewalls of the top wall 1121 and the bottom wall 1122 respectively. The second main body 12 includes a base portion 121, an extension portion 122 vertically and downwardly extending from the base portion 121, and a pair of latch arms 123 upwardly extending from the two opposite sides of the base portion 121. The conjunction portion of the base portion 121 and the extension portion 122 forms a step shape. Each of the latch arms 123 includes a vertical portion 1231 and a projecting latch portion 1232 inwardly extending from a free end of the vertical portion 1231. The first main body 11 defines a mating portion 113 fixed with the latch portions 1323. The extension portion 122 includes a front surface 1221 and an opposite rear surface 1222. The extension portion 122 rearwardly defines a plurality of recessing first receiving slots (not shown) on the front surface 1221 for receiving the soldering portion 213 of the first contacts 21. The extension portion 122 forwardly defines a plurality of recessing third receiving slots (not shown) on the rear surface 1222 for receiving the soldering portion 235 of the third contacts 23. The base portion 121 of the second main body 12 forwardly defines a plurality of recessing second receiving slots 1225 for receiving the soldering portion 227 of the second contacts 22.

The shielding case 4 is made of metallic material, including a first shielding case 41, a second shielding case 42 engaged with the first shielding case 41 and a third shielding case 43 engaged with the second shielding case 42. The first shielding case 41 includes a tubular portion 411 disposed on a front end thereof and a drawer portion 412 rearwardly extending from the tubular portion 411. A section of the tubular portion 411 includes a top edge, an opposite bottom edge and two opposite side edges connecting the top edge and the bottom edge. The lateral dimension of the top edge is greater than the bottom edge. Each of the side edges defines a stepped portion. The two stepped portion of the side edges is symmetrical to each other.

The cable 3 includes a plurality of wires 31 electrically connecting to the corresponding contacts 2 and an insulative outer coating 32 enclosing the corresponding wires 31. The insulative outer coating 32 extends along a direction away from the docking direction. The extending direction of the insulative outer coating 32 forms an angle with the extending direction of the second main body 12. In the present embodiment the angel between the extending direction of the insulative outer coating 32 and the second main body 12 is 135 degrees. The wires 31 are arranged in three rows, respectively 33, 34, and 35. Each of the wires 31 includes a core wire 311 soldered with the corresponding soldering portions 215, 227, 235 of the contacts 2. The core wires 311 of the first row of wires 33 are soldered with the soldering portions 213 of the first contacts 21. The core wires 311 of the second row of wires 34 are soldered with the soldering portions 235 of the third contacts 23. The core wires 311 of the third row of wires 35 are soldered with the soldering portion 227 of the second contacts 22. In practical embodiments, because of the wire load of the second row of wires 34 is 100 w, the diameter dimension of each core wire 311 of the second row of wires 34 is larger. In other words, the diameter dimension of each core wire 311 of the second row of wires 34 is greater than the diameter dimension of each core wire 311 of the second and the third row of wires 33, 35. In the present embodiment, the wires 31 arranged in a same row have a same diameter dimension, and the second row of wires 34 is disposed intermediate position, it is more conducive to automated weld the cable 3 and the corresponding contacts 2.

The cable connector assembly 100 further includes an outer case 5 enclosing a rear end of the shielding case 4 and a front end of the cable 3. The thickness of the outer case 5 along the docking direction is 7.3 mm, in present embodiment, the second main body 12 according to the present invent extends along the direction vertical to the extending direction of the first main body 11, it is more conducive to reducing the thickness of the outer case 5 enclosing the shielding case 4. The insulative outer coating 32 of the cable 3 extends along the direction away from the docking direction and defines a angle relative to the extending direction of the second main body 12, so that, meeting customer needs, having a more aesthetically pleasing appearance.

What is claimed is:

1. A cable connector assembly comprising:

an insulative housing;

a plurality of contacts retained in the insulative housing; a cable including a plurality of wires electrically connected with the contacts and an insulative outer coating enclosing the wires; and a shielding case enclosing the insulative housing; wherein the insulative housing includes a first main body extending along a docking direction and a second main body extending along a direction perpendicular to the docking direction, an end of the second main body is exposed to the first main body along the docking direction, and the insulative outer coating of the cable extends along a direction away from the docking direction to form an angle relative to the extending direction of the second main body;

the first contacts includes two pairs of differential signal contacts and a grounding contact, all of which are arranged in accordance with standard type B USB 3.0 arrangement; one of the two pairs of differential signal contacts is used for outputting high-speed signals, another is used for receiving high-speed signals; the grounding contact is located between the two pairs of differential signal contacts, for reducing the differential signal terminals crosstalk in high-speed signal transmission;

the second contacts include four contacts, which include a power contact, a grounding contact, a positive signal contact and a negative signal contact, all of which are arranged in accordance with standard type B USB2.0 arrangement;

the third contacts includes a additional power supply contact and an additional grounding contact.

2. The cable connector assembly as claimed in claim 1, wherein the angle is 135 degrees.

3. The cable connector assembly as claimed in claim 1, wherein the shielding case include a first shielding case, a second shielding case engaged with the first shielding case, and a third shielding case engaged with the second shielding case, and the first shielding case includes a front tubular portion and a rear drawer portion.

4. The cable connector assembly as claimed in claim 1, further comprising an outer case enclosing a rear end of the insulative housing and a front end of the cable, and wherein a thickness of the outer case measured along a docking direction is 7.3 mm.

5. The cable connector assembly as claimed in claim 1, wherein the first main body defines a first receiving room and a second receiving room, each of the contacts defines a contacting portion and a soldering portion, the plurality of contacts include the contacting portions of the first contacts are received in the first receiving room, and the contacting portions of the second contacts are received in the second receiving room.

6. The cable connector assembly as claimed in claim 3, the second receiving room is surrounded by a top wall, a bottom wall, and two side walls, the contacting portions of the additional power supply contact and the additional grounding contact being respectively received in the two side walls.

7. The cable connector assembly as claimed in claim 6, wherein the wires of the cable are arranged in three rows, each of the wires includes a core wire electrically connected with a corresponding contact, the core wires of the first row of wires are electrically connected with the soldering portions of the first contacts, the core wires of the second row of wires are electrically connected with the soldering portions of the third contacts, the core wires of the third row of contacts are electrically connected with the soldering portions of the second contacts, a diameter of the core wire in the second row of wires is greater than a diameter of the core wire in the first row of wires, and a diameter of the core wire in the second row of wires is greater than a diameter of the core wire in the third row of wires.

8. The cable connector assembly as claimed in claim 1, wherein the second main body includes a base portion, an extension portion vertically and downwardly extending from the base portion, and a pair of latch arms extending upwardly from two opposite sides of the base portion, and a conjunction portion of the base portion and the extension portion is of stepped shape.

9. The cable connector assembly as claimed in claim 8, wherein each of the latch arms includes a vertical portion and a protruding latch portion inwardly extending from a free end of the latch arm, and the first main body defines a mating portion fixed with the latch portion.

10. The cable connector assembly as claimed in claim 8, wherein the extension portion defines opposite front and rear surfaces, a plurality of rearwardly recessing first receiving slots on the front surface for receiving the soldering portions of the first contacts, and a plurality of forwardly recessing third receiving slots for receiving the soldering portions of the third contacts, and the base portion defines a plurality of forward second receiving slots for receiving the soldering portions of the second contacts.

11. A cable connector assembly comprising:

an insulative housing;

a plurality of upper contacts and a plurality of lower contacts retained in the insulative housing, each of said upper contacts and said lower contacts including a front contacting section and rear soldering section in a front-to-back direction;

a cable including a plurality of wires electrically and mechanically connected to the soldering sections of the corresponding contacts; and a metallic shielding case enclosing the insulative housing to commonly form an upper receiving room and a lower receiving room in a vertical direction perpendicular to said front-to-back direction; wherein the front contacting sections of the upper contacts are located in the upper receiving room, and the front contacting sections of the lower contacts are located in the lower receiving room; wherein the insulative housing includes a first main body extending along said front-to-back direction and a second main body located behind and assembled to the first main body, said second main body defining a front face and a rear face opposite to each other in the front-to-back direction; wherein the soldering sections of the lower contacts are located upon the front face while the soldering sections of the upper contacts are located upon the rear face;

the first contacts includes two pairs of differential signal contacts and a grounding contact, all of which are arranged in accordance with standard type B USB 3.0 arrangement; one of the two pairs of differential signal contacts is used for outputting high-speed signals, another is used for receiving high-speed signals; the grounding contact is located between the two pairs of differential signal contacts, for reducing the differential signal terminals crosstalk in high-speed signal transmission;

the second contacts include four contacts, which include a power contact, a grounding contact, a positive signal contact and a negative signal contact, all of which are arranged in accordance with standard type B USB2.0 arrangement;

the third contacts includes a additional power supply contact and an additional grounding contact.

12. The cable connector assembly as claimed in claim 11, wherein the soldering sections of the upper contacts are arranged in two different vertical planes in said front-to-back direction.

13. The cable connector assembly as claimed in claim 11, wherein the soldering sections of the lower contacts are located below the lower receiving room in the vertical direction.

14. The cable connector assembly as claimed in claim 11, wherein each of said front face and said rear face lies in a vertical plane perpendicular to said front-to-back direction.

15. The cable connector assembly as claimed in claim 14, wherein said second main body extends in the vertical direction and upwardly assembled to the first main body in said vertical direction.

16. The cable connector assembly as claimed in claim 14, further including an insulative outer coating covering the cable and extending along a direction oblique to both said front-to-back direction and said vertical direction.

17. The cable connector assembly as claimed in claim 16, further including an insulative outer case enclosing the shielding case and a front portion of the cable, wherein said outer case includes an upper vertical portion and a lower oblique portion.

18. A cable connector assembly comprising: an insulative housing;

a plurality of upper contacts and a plurality of lower contacts retained in the insulative housing, each of said upper contacts and said lower contacts including a front contacting section and rear soldering section in a front-to-back direction;

a cable including a plurality of wires electrically and mechanically connected to the soldering sections of the corresponding contacts;

a metallic shielding case enclosing the insulative housing to commonly form an upper receiving room and a lower receiving room in a vertical direction perpendicular to said front-to-back direction, the front contacting sections of the upper contacts being located in the upper receiving room, and the front contacting sections of the lower contacts being located in the lower receiving room; and an insulative outer case enclosing the shielding case and a front portion of the cable; wherein said outer case includes an upper vertical portion extending in a vertical plane and a lower oblique portion extending in an oblique plane angled to both said front-to-back direction and said front-to-back direction, and the soldering sections of both said upper contacts and said lower contacts are embedded within only the vertical portion;

the first contacts includes two pairs of differential signal contacts and a grounding contact, all of which are arranged in accordance with standard type B USB 3.0 arrangement; one of the two pairs of differential signal contacts is used for outputting high-speed signals, another is used for receiving high-speed signals; the grounding contact is located between the two pairs of differential signal contacts, for reducing the differential signal terminals crosstalk in high-speed signal transmission;

the second contacts include four contacts, which include a power contact, a grounding contact, a positive signal contact and a negative signal contact, all of which are arranged in accordance with standard type B USB2.0 arrangement;

the third contacts includes a additional power supply contact and an additional grounding contact.

19. The cable connector assembly as claimed in claim 18, wherein said housing includes a first main body extending along the front-to-back direction, and a second main body extending along the vertical direction and upwardly assembled to the first main body in said vertical direction.

20. The cable connector assembly as claimed in claim 19, further includes another metallic shielding case assembled to said shielding case to cover a back side of the housing and the front portion of the cable.

* * * * *